US009722315B2

(12) United States Patent
Kletsov et al.

(10) Patent No.: US 9,722,315 B2
(45) Date of Patent: Aug. 1, 2017

(54) ULTRA-WIDEBAND (UWB) DIPOLE ANTENNA

(71) Applicant: Samsung Electronics Co., Ltd., Suwon-si (KR)

(72) Inventors: Andrey Vladimorovich Kletsov, Moscow (RU); Artem Rudolfovich Vilenskiy, Moscow (RU); Vladimir Yakovlevich Arkhipenkov, Moscow (RU); Jongjin Kim, Hwaseong-si (KR); Dongwook Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 321 days.

(21) Appl. No.: 14/177,603

(22) Filed: Feb. 11, 2014

(65) Prior Publication Data

US 2014/0225797 A1 Aug. 14, 2014

(30) Foreign Application Priority Data

Feb. 11, 2013 (RU) ..... 2013105648
Sep. 17, 2013 (KR) ..... 10-2013-0111662

(51) Int. Cl.
*H01Q 9/16* (2006.01)
*H01Q 9/28* (2006.01)

(52) U.S. Cl.
CPC ..... *H01Q 9/285* (2013.01); *H01Q 9/28* (2013.01)

(58) Field of Classification Search
CPC ..... H01Q 9/285; H01Q 9/28
USPC ..... 343/822, 718, 767, 769, 776, 793, 795, 343/799, 700 MS
See application file for complete search history.

(56) References Cited

U.S. PATENT DOCUMENTS 5,355,143 A * 10/1994 Zurcher ..... H01Q 9/0457 343/700 MS
6,946,995 B2 9/2005 Choi et al.
7,190,320 B2 3/2007 Okado
7,277,055 B2 10/2007 Tamaoka
2007/0200762 A1* 8/2007 Frank ..... H01Q 9/40 343/700 MS (Continued)

FOREIGN PATENT DOCUMENTS

JP 4231457 B2 12/2008
JP 2013-88364 A 5/2013

(Continued)

*Primary Examiner* — Graham Smith
*Assistant Examiner* — Jae Kim
(74) *Attorney, Agent, or Firm* — NSIP Law

(57) ABSTRACT

An ultra-wideband (UWB) antenna for wireless communication in proximity to a human body and between devices having no line-of-sight, includes symmetrical radiators disposed on a side of a dielectric layer, and a differential microstrip feeding line disposed on the side and an opposite side of the dielectric layer. The UWB antenna further includes a top dielectric layer disposed over the side of the dielectric layer, a bottom dielectric layer disposed over the opposite side of the dielectric layer, and a top connecting plate disposed on an outer surface of the top dielectric layer. The UWB antenna further includes a bottom connecting plate disposed on an outer surface of the bottom dielectric layer, and an inter-layer connector configured to connect ends of each of the symmetrical radiators to the top connecting plate and the bottom connecting plate, respectively.

14 Claims, 5 Drawing Sheets

(56) References Cited

U.S. PATENT DOCUMENTS

2013/0088406 A1 4/2013 Hamada et al.

FOREIGN PATENT DOCUMENTS

| | | | |
|---|---|---|---|
| KR | 10-2001-0026643 | A | 4/2001 |
| KR | 10-0956746 | B1 | 5/2010 |
| KR | 10-0969149 | B1 | 7/2010 |

* cited by examiner

ULTRA-WIDEBAND (UWB) DIPOLE ANTENNA

CROSS-REFERENCE TO RELATED APPLICATIONS

This application claims the benefit under 35 USC 119(a) of Russian Patent Application No. 2013105648, filed on Feb. 11, 2013, in the Russian Federal Service for Intellectual Property, and Korean Patent Application No. 10-2013-0111662, filed on Sep. 17, 2013, in the Korean Intellectual Property Office, the entire disclosures of which are incorporated herein by reference for all purposes.

BACKGROUND

1. Field

The following description relates to an ultra-wideband (UWB) dipole antenna.

2. Description of Related Art

The rapid development of miniature devices having wireless communication capabilities has led to more stringent requirements on a size of electronic components. One of the biggest elements of such systems is an antenna. Wireless communications standards, such as the Institute of Electrical and Electronics Engineers (IEEE) 802.15.6, are emerging. The standards allow work at sufficiently high frequencies, for example, 6 to 10 gigahertz (GHz), and thus reduce the physical size of the antenna.

However, for a number of devices, such as devices working in close proximity to a human body, size limitations are especially small. In this case, additional measures may be needed to reduce the antenna dimensions used in such devices. In general, devices working in close proximity to a human body are self-powered, and have a serious limitation of energy consumption. In this situation, there is a desire for a method of minimizing power consumption of each block of a device.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, there is provided an ultra-wideband (UWB) antenna for wireless communication in proximity to a human body and between devices having no line-of-sight, the UWB antenna including symmetrical radiators disposed on a side of a dielectric layer, and a differential microstrip feeding line disposed on the side and an opposite side of the dielectric layer. The UWB antenna further includes a top dielectric layer disposed over the side of the dielectric layer, a bottom dielectric layer disposed over the opposite side of the dielectric layer, and a top connecting plate disposed on an outer surface of the top dielectric layer. The UWB antenna further includes a bottom connecting plate disposed on an outer surface of the bottom dielectric layer, and an inter-layer connector configured to connect ends of each of the symmetrical radiators to the top connecting plate and the bottom connecting plate, respectively. The symmetrical radiators include inner holes, each of the symmetrical radiators has an U-shape, the ends of each of the symmetrical radiators are cut, and outer perimeters of the symmetrical radiators include outer holes.

The symmetrical radiators have inner perimeters and the outer perimeters, each of which has a geometric shape.

Each of the inner holes and the outer holes has a geometric shape.

The differential microstrip feeding line is disposed orthogonally to a symmetrical plane YZ of the UWB antenna.

A number of each of the inner holes and the outer holes is at least two.

Each of the top connecting plate and the bottom connecting plate has a geometric shape.

In another general aspect, there is provided an ultra-wideband (UWB) antenna including a middle dielectric layer, a first sub-radiator and a second sub-radiator, having substantially identical sizes and shapes, and disposed on a side of the middle dielectric layer, and a top connecting plate connected to an end of the first sub-radiator. The UWB antenna further includes a bottom connecting plate connected to an end of the second sub-radiator, a differential microstrip feeding line disposed on the side and an opposite side of the middle dielectric layer, and a top dielectric layer disposed on the side of the middle dielectric layer. The UWB antenna further includes a bottom dielectric layer disposed on the opposite side of the middle dielectric layer, a first sub-inter-layer connector configured to connect the top connecting plate and the first sub-radiator, and a second sub-inter-layer connector configured to connect the bottom connecting plate and the second sub-radiator.

The first sub-radiator and the second sub-radiator include holes at substantially identical locations.

Each of the first sub-radiator and the second sub-radiator includes at least one of an inner hole disposed on an inner perimeter and an outer hole disposed on an outer perimeter.

Each of the first sub-radiator and the second sub-radiator includes at least one of the inner hole and the outer hole so that each of the first sub-radiator and the second sub-radiator has an U-shape.

The inner hole has a shape of overlapping circles or overlapping ellipses.

The outer hole has a shape of a circle or an ellipse, and includes outer holes.

The first sub-inter-layer connector is disposed through the top dielectric layer to connect the top connecting plate and the first sub-radiator, and the second sub-inter-layer connector is disposed through the bottom dielectric layer to connect the bottom connecting plate and the second sub-radiator.

The differential microstrip feeding line is disposed through a geometric center of the UWB antenna.

A width of the differential microstrip feeding line is configured to match an input of the UWB antenna to a 50 ohm resistance.

The first sub-radiator and the second sub-radiator are disposed between the top dielectric layer and the middle dielectric layer.

In still another general aspect, there is provided an ultra-wideband (UWB) antenna including a first dielectric layer, radiators disposed on a side of the first dielectric layer, a second dielectric layer disposed on the radiators and the side of the first dielectric layer, and a third dielectric layer disposed on an opposite side of the first dielectric layer. The UWB antenna further includes a first plate disposed on a surface of the second dielectric layer, a second plate disposed on a surface of the third dielectric layer, and a connector configured to connect the radiators to the first plate and the second plate, respectively.

The UWB antenna further includes a feeding line disposed in a portion between the first dielectric layer and the second dielectric layer and another portion between the first dielectric layer and the third dielectric layer.

The connector is disposed along an Y-axis through each of the second dielectric layer and the third dielectric layer, and the feeding line is disposed along an X-axis through a geometric center of the UWB antenna.

Other features and aspects will be apparent from the following detailed description, the drawings, and the claims.

Figure 1:
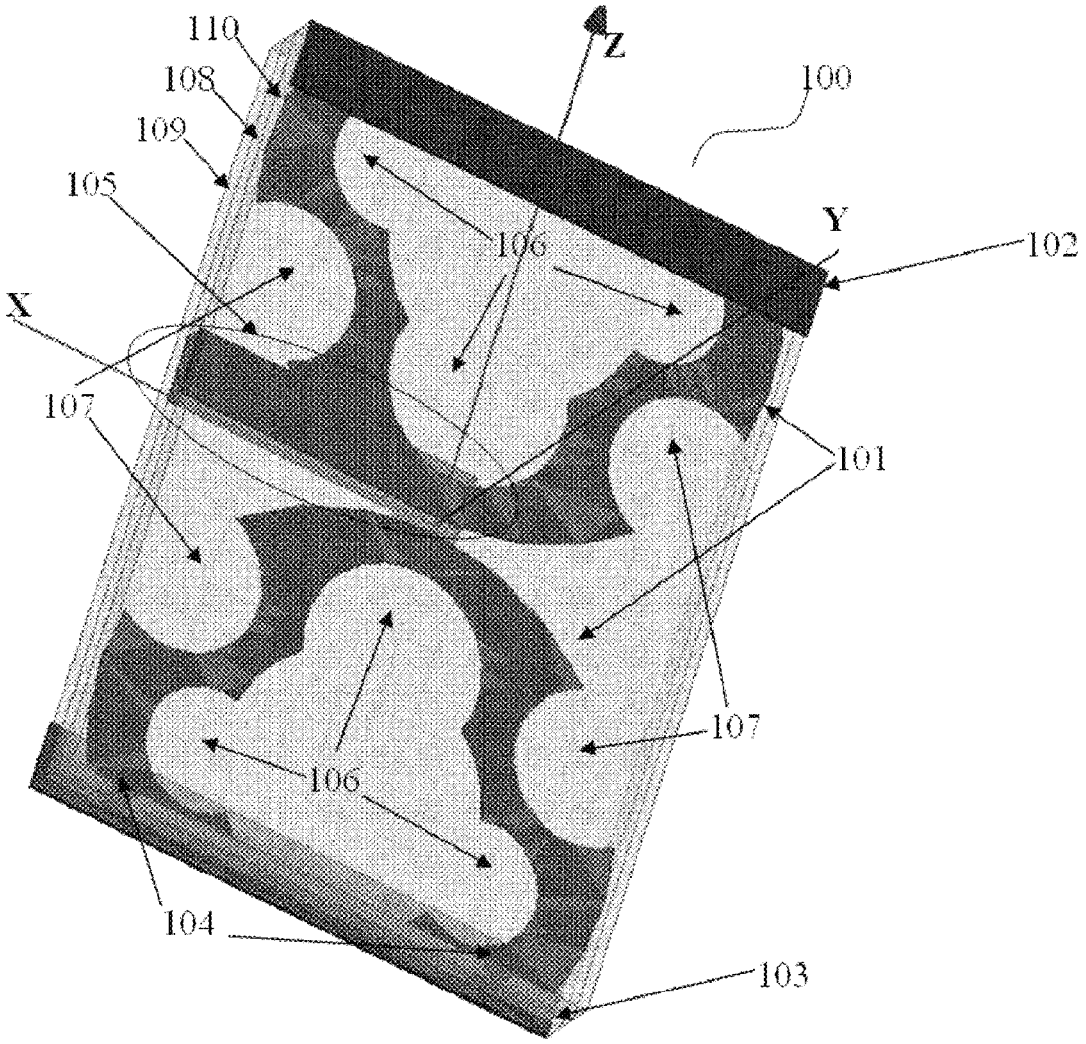
FIG. 1 is a perspective view illustrating an example of a structure of an antenna.

Throughout the drawings and the detailed description, unless otherwise described or provided, the same drawing reference numerals will be understood to refer to the same elements, features, and structures. The drawings may not be to scale, and the relative size, proportions, and depiction of elements in the drawings may be exaggerated for clarity, illustration, and convenience.

DETAILED DESCRIPTION

The following detailed description is provided to assist the reader in gaining a comprehensive understanding of the methods, apparatuses, and/or systems described herein. However, various changes, modifications, and equivalents of the systems, apparatuses and/or methods described herein will be apparent to one of ordinary skill in the art. Also, descriptions of functions and constructions that are well known to one of ordinary skill in the art may be omitted for increased clarity and conciseness.

The features described herein may be embodied in different forms, and are not to be construed as being limited to the examples described herein. Rather, the examples described herein have been provided so that this disclosure will be thorough and complete, and will convey the full scope of the disclosure to one of ordinary skill in the art.

Unless indicated otherwise, a statement that a first layer is "on" a second layer or a substrate is to be interpreted as covering both a case where the first layer is directly contacts the second layer or the substrate, and a case where one or more other layers are disposed between the first layer and the second layer or the substrate.

The spatially-relative expressions such as "below", "beneath", "lower", "above", "upper", and the like may be used to conveniently describe relationships of one device or elements with other devices or among elements. The spatially-relative expressions should be understood as encompassing the direction illustrated in the drawings, added with other directions of the device in use or operation. Further, the device may be oriented to other directions and accordingly, the interpretation of the spatially-relative expressions is based on the orientation.

FIG. 1 illustrates an example of a structure of an antenna 100. Referring to FIG. 1, the antenna 100 includes two radiators 101, a top connecting plate 102, a bottom connecting plate 103, a differential microstrip feeding line 105, a bottom dielectric layer 109, a middle dielectric layer 108, a top dielectric layer 110, and an inter-layer connector 104.

The radiators 101 radiate electromagnetic (EM) waves, using a fed power. The radiators 101 may include at least one of inner holes 106 and outer holes 107 as shown in FIG. 1. The inner holes 106 may correspond to cutouts generated by cutting inner portions of the radiators 101, and each of the inner holes 106 may be provided in a shape formed by overlapping ellipses or circles, as shown in FIG. 1. However, the shape of each of the inner holes 106 as shown in FIG. 1 is provided as an example only, and each of the inner holes 106 may be provided in any other geometric shape. For example, each of the inner holes 106 may be formed for a shape of an inner perimeter of a respective one of the radiators 101 to be of any other geometric shape, for example, a polygon or a circle. As shown in FIG. 1, ends of the radiators 101 may be cut so that each of the radiators 101 may be provided in a U-shape. In addition, although FIG. 1 illustrates a single one of the inner holes 106 included in each of the radiators 101, a number of the inner holes 106 included in each of the radiators 101 is not limited thereto.

The outer holes 107 may correspond to cutouts generated by cutting portions of outer perimeters of the radiators 101, and each of the outer holes 107 may be provided in a shape of a portion of an ellipse or a circle, as shown in FIG. 1. However, the shape of each of the outer holes 107 is provided as an example only, and each of the outer holes 107 may be provided in any other geometric shape. For example, each of the outer holes 107 may be formed for a shape of an outer perimeter of a respective one of the radiators 101 to be of any other geometric shape, for example, a polygon or a circle. As shown in FIG. 1, ends of the radiators 101 may be cut so that each of the radiators 101 may be provided in a U-shape. In addition, although FIG. 1 illustrates two of the outer holes 107 included in each of the radiators 101, a number of the outer holes 107 included in each of the radiators 101 is not limited thereto.

Although it is described that the inner holes 106 or the outer holes 107 are generated by cutting inner portions and outer perimeters, respectively, of the radiators 101, the description is provided as an example only. The radiators 101 may be manufactured to have at least one of the inner holes 106 and the outer holes 107, and those skilled in the art may easily understand that there is no limitation on a process of generating a shape of each of the radiators 101.

The two radiators 101 may be symmetrical. As shown in FIG. 1, the radiators 101 may have substantially identical sizes and shapes. In addition, the radiators 101 may include the inner holes 106 and/or the outer holes 107 at substantially identical locations.

The radiators 101 are disposed between the top dielectric layer 110 and the middle dielectric layer 108. The top dielectric layer 110 is disposed on the middle dielectric layer 108, and the middle dielectric layer 108 is disposed on the bottom dielectric layer 109. The top dielectric layer 110 and middle dielectric layer 108 may be in contact with or disposed adjacent to each other. Also, the bottom dielectric layer 109 and middle dielectric layer 108 may be in contact with or disposed adjacent to each other. The two radiators 101 may also be referred to as a first sub-radiator and a second sub-radiator, respectively. In this example, the first sub-radiator and the second sub-radiator may have substantially identical sizes and shapes. In addition, the first sub-radiator and the second sub-radiator may be disposed symmetrical to each other.

At least one of the top connecting plate 102 and the bottom connecting plate 103 may be provided in a rectangular shape. Each of the top connecting plate 102 and the bottom connecting plate 103 may be provided in any other geometric shape, for example, a polygon or an ellipse.

The top connecting plate 102 is disposed on the top dielectric layer 110. For example, the top connecting plate 102 may be provided in a rectangular shape that extends in a lateral direction on an upper side of the top dielectric layer 110. The top connecting plate 102 is connected to an end of a top radiator of the radiators 101. For example, the top radiator may be provided in a U-shape, and both U-shaped ends of the top radiator may be connected to the top connecting plate 102.

The bottom connecting plate 103 is disposed on a bottom surface of the bottom dielectric layer 109. For example, the bottom connecting plate 103 may be provided in a rectangular shape that extends in a lateral direction on a lower side of the bottom dielectric layer 109. The bottom connecting plate 103 is connected to an end of a bottom radiator of the radiators 101. For example, the bottom radiator may be provided in an inverted U-shape, and both U-shaped ends of the bottom radiator may be connected to the bottom connecting plate 103.

The inter-layer connector 104 electrically connects ends of each of the radiators 101 to respective external connecting plates, for example, the top connecting plate 102 and the bottom connecting plate 103. A structure of the inter-layer connector 104 will be further described in detail.

The differential microstrip feeding line 105 is disposed on both sides of the middle dielectric layer 108. A structure of the differential microstrip feeding line 105 will be further described in detail.

Human body tissues have a relatively high dielectric constant and a relatively low conductivity. Under such conditions, an EM wave propagating near a human body surface undergoes serious attenuation. However, under certain conditions, EM waves may propagate around curved object surfaces. This phenomenon is called surface waves, and is a kind of diffraction. With this propagation, the EM waves undergo minimal attenuation. Conditions for such phenomenon emergence may include vertical wave polarization respective to an object surface, a high value of permittivity of an object material, and a large object size compared to a wavelength.

When the antenna 100 meets such conditions, the antenna 100 may send information along a surface of a body, being placed on different sides of the body, and without direct path propagation. This may reduce a power consumption of transceiver radio modules in devices.

As described above, the UWB antenna 100 may be manufactured in smaller dimensions, in comparison with related art, which allow establishment of wireless communication channels on a surface or in close proximity to a human body with a small signal attenuation, and provide minimization of demanded transmit power and sensitivity of a receiver. Quality of wireless communication in close proximity to the human body between devices having no line-of-sight may be improved.

Figure 2A:
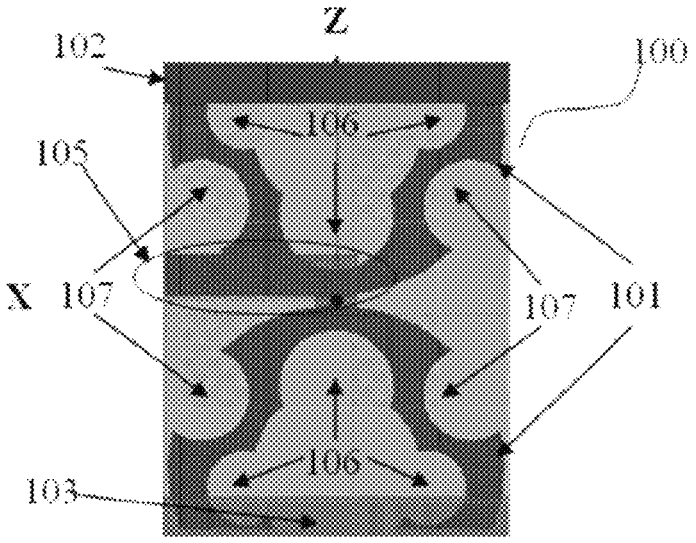
FIG. 2A is a plan view illustrating an example of a slit on a plane ZX of the antenna of FIG. 1.
Figure 2B:
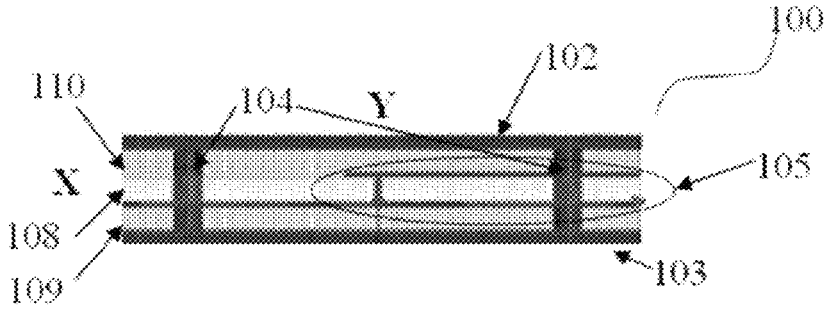
FIG. 2B is a cross-sectional view illustrating an example of a slit on a plane XY of the antenna of FIG. 1.
Figure 2C:
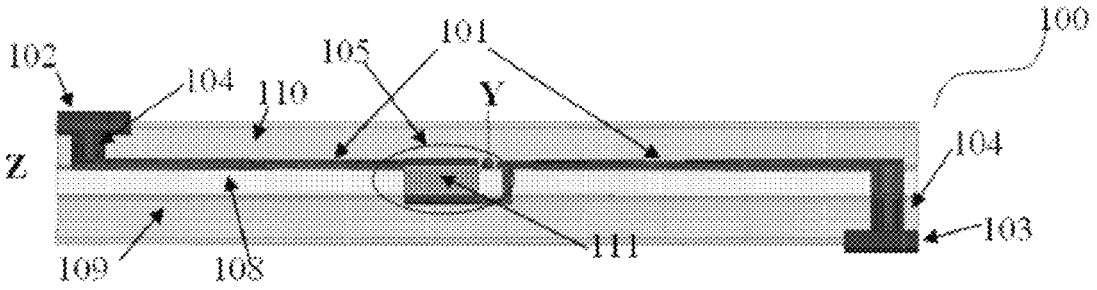
FIG. 2C is a cross-sectional view illustrating an example of a slit on a plane YZ of the antenna of FIG. 1.

FIGS. 2A through 2C illustrate examples of slits on planes of the antenna 100 of FIG. 1. FIG. 2A illustrates an example of a slit on a plane ZX of the antenna 100 of FIG. 1, FIG. 2B illustrates an example of a slit on a plane XY of the antenna 100 of FIG. 1, and FIG. 2C illustrates an example of a slit on a plane YZ of the antenna 100 of FIG. 1. In FIG. 2C, a signal feeding point 111 of the antenna 100 is marked.

Referring to FIG. 2A, the radiators 101 may include at least one of the inner holes 106 and the outer holes 107. The inner holes 106 may correspond to cutouts generated by cutting inner portions of the radiators 101, and each of the inner holes 106 may be provided in a shape formed by overlapping ellipses or circles, as shown in FIG. 2A. The outer holes 107 may correspond to cutouts generated by cutting portions of outer perimeters of the radiators 101, and each of the outer holes 107 may be provided in a shape of a portion of an ellipse or a circle, as shown in FIG. 1. However, the shape of each of the inner holes 106 and the outer holes 107 is provided as an example only, and each of the inner holes 106 and the outer holes 107 may be provided in any other geometric shape. For example, each of the inner holes 106 and the outer holes 107 may be formed for a shape of an inner or outer perimeter of a respective one of the radiators 101 to be of any other geometric shape, for example, a polygon or a circle. As shown in FIG. 2A, ends of the radiators 101 may be cut so that each of the radiators 101 may be provided in a U-shape. In addition, although FIG. 2A illustrates two of the outer holes 107 included in each of the radiators 101, a number of the outer holes 107 included in each of the radiators 101 is not limited thereto. The two radiators 101 may be symmetrical.

At least one of the top connecting plate 102 and the bottom connecting plate 103 may be provided in a rectangular shape. Each of the top connecting plate 102 and the bottom connecting plate 103 may be provided in any other geometric shape, for example, a polygon or an ellipse.

The top connecting plate 102 is disposed on the top dielectric layer 110. For example, the top connecting plate 102 may be provided in a rectangular shape that extends in a lateral direction on an upper side of the top dielectric layer 110. The top connecting plate 102 is connected to an end of a top radiator of the radiators 101. For example, the top radiator may be provided in a U-shape, and both U-shaped ends of the top radiator may be connected to the top connecting plate 102.

The bottom connecting plate 103 is disposed on a bottom surface of the bottom dielectric layer 109. For example, the bottom connecting plate 103 may be provided in a rectangular shape that extends in a lateral direction on a lower side of the bottom dielectric layer 109. The bottom connecting plate 103 is connected to an end of a bottom radiator of the radiators 101. For example, the bottom radiator may be provided in an inverted U-shape, and both U-shaped ends of the bottom radiator may be connected to the bottom connecting plate 103.

As to be described in detail, ends of each of the radiators 101 are electrically-connected to the top connecting plate 102 and the bottom connecting plate 103, respectively, using the inter-layer connector 104.

Referring to FIG. 2B, the inter-layer connector 104 connects the dielectric layers 108, 109, and 110. The inter-layer connector 104 is formed to extend in an Y-axial direction. The inter-layer connector 104 electrically connects the ends of each of the radiators 101 to respective external connecting plates, for example, the top connecting plate 102 and the bottom connecting plate 103. Although FIG. 2B illustrates the inter-layer connector 104 connecting the three dielectric layers 108, 109, and 110, the inter-layer connector 104 includes two inter-layer connectors that connect the top dielectric layer 110 and the middle dielectric layer 108, and the middle dielectric layer 108 and the bottom dielectric layer, respectively. A more detailed configuration of the two inter-layer connectors will be described with reference to FIG. 2C.

The differential microstrip feeding line 105 is disposed on both sides of the middle dielectric layer 108.

Referring to FIG. 2C, the top connecting plate 102 is disposed at an upper left end of the plane YZ and on the top dielectric layer 110. The inter-layer connector 104 includes a first sub-inter-layer connector connected to the top connecting plate 102. The first inter-layer connector is formed to extend in the Y-axial direction on the plane YZ, and connects the top radiator of the radiators 101 disposed on the middle dielectric layer 108 to the top connecting plate 102.

The bottom connecting plate 103 is disposed at a lower right end of the plane YZ and on the bottom surface of the bottom dielectric layer 109. The inter-layer connector 104 includes a second inter-layer connector connected to the bottom connecting plate 103. The second sub-inter-layer connector is formed to extend in the Y-axial direction on the plane YZ, and connects the bottom radiator of the radiators 101 disposed on the middle dielectric layer 108 to the bottom connecting plate 103.

The antenna 100 is powered through the differential microstrip feeding line 105 routed from a periphery of the antenna 100 to the signal feeding point 111. The differential microstrip feeding line 105 is perpendicular or orthogonal to the symmetrical plane YZ of the main antenna 100, and passes along an X-axis through a geometric center of the antenna 100. A width of the differential microstrip feeding line 105 may vary to match an antenna input to a 50 ohm resistance.

Figure 3:
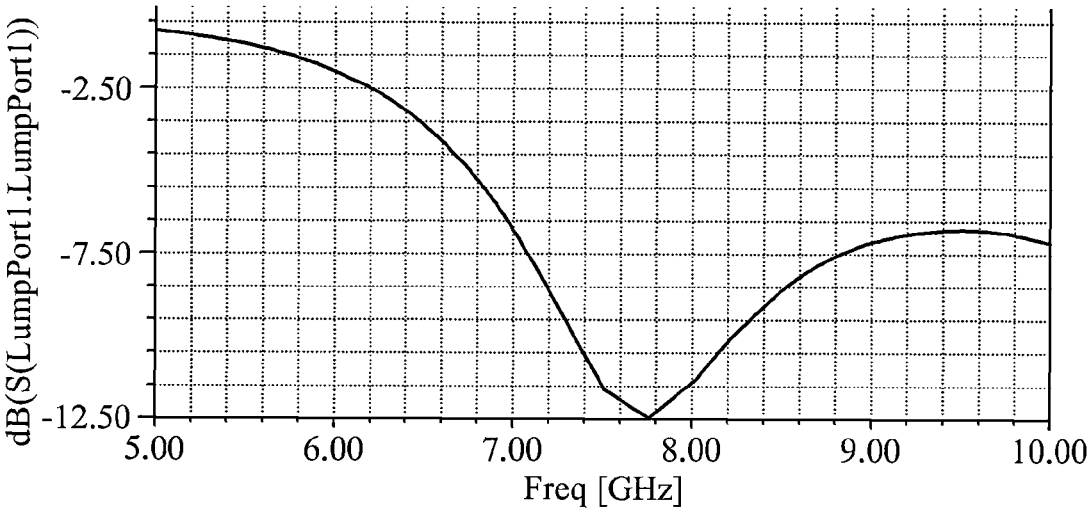
FIG. 3 is a graph illustrating an example of a frequency dependency of a reflection coefficient of an antenna disposed near a surface of a human body.

FIG. 3 illustrates an example of a frequency dependency of a reflection coefficient S(LumpPort1.LumpPort1) of an antenna disposed near a surface of a human body. Referring to FIG. 3, a frequency range is 5 to 10 gigahertz (GHz). Antenna matching measured in terms of the reflection coefficient S(LumpPort1.LumpPort1) being less than −6 decibels (dB) is in about a 6.8 to 10 GHz band corresponding to a high-frequency range.

The UWB antenna 100 may be used to transmit and receive UWB radio signals in miniature devices for communication networks operating in close proximity to a surface of a human body. For better performance in such networks, emitted signal polarization is to be orthogonal to the surface of the human body. For such a reason, a location of the antenna 100 may be vertical to a Z-axis orthogonal to the surface of the human body. The antenna 100 may be fabricated of any multilayer printed circuit board (PCB) materials like FR-4.

Since the UWB antenna 100 is implemented in a form of a planar dipole, for proper operation, the antenna 100 may not need any additional metallized layer from other boards and/or any other layer known to one of ordinary skill in the art. The antenna 100 includes the two identical radiators 101 disposed to be mirrored to each other. Both of the radiators 101 may have elliptical outer and inner perimeters. The shape of each of the perimeters of the radiators 101 may be of any other geometric shape, like a polygon or a circle. In addition, ends of the radiators 101 may be cut so that each of the radiators 101 may be provided in a U-shape.

Along the inner and outer perimeters of the radiators 101, the inner holes 106 and the outer holes 107 may be generated respectively. Each of the inner holes 106 and the outer holes 107 may be a portion of a circular shape, and also be provided in any other geometric shape, for example, a polygon or an ellipse. A number of the inner holes 106 may be determined at random to be at least two. A number of the outer holes 107 may also be determined to be at least two.

The radiators 101 may be disposed on one side of the middle dielectric layer 108. On both sides of the middle dielectric layer 108, the differential microstrip feeding line 105 may be disposed. Each side of the middle dielectric layer 108 may be closely adjacent to additional dielectric layers, for example, the bottom dielectric layer 109 and the top dielectric layer 110. On outer sides or surfaces of the additional dielectric layers, for example, the bottom dielectric layer 109 and the top dielectric layer 110, the bottom connecting plate 103 and the top connecting plates 102 may be disposed respectively. Thicknesses of the middle dielectric layer 108, the bottom dielectric layer 109, and the top dielectric layer 110, may be selected to adjust the antenna 100. The antenna 100 may be disposed in a free space inside or outside a device case.

FIG. 3 illustrates a bandwidth of the antenna by the example of the frequency dependency of the reflection coefficient. In the graph, a frequency band may be estimated in a region in which the reflection coefficient is lower than −6 dB. In this example, the frequency band of FIG. 3 may be about 6.8 to 10 GHz. An optimized matching resonant frequency may be about 7.7 GHz in the presented frequency dependency.

The examples of the antenna described may be used for wireless communication between devices disposed near a human body and also between devices disposed on-body and off-body. A presence of a direct path for on-body signal propagation may be unnecessary because a vertically-polarized radio signal emitted by the antenna may spread along a curved surface of the human body with small attenuation, when compared to inside-body signal propagation. Due to a small size of the antenna, the antenna may be used in a frequency range of the IEEE 802.15.6 standard for wireless networks operating near a surface of a human body. Devices including the antenna may be small-sized, and include, for example, a hearing aid, a phone, and/or a Moving Picture Experts Group (MPEG) Audio Layer 3 (MP3) player.

As a non-exhaustive illustration only, a device described herein may refer to mobile devices such as, for example, a cellular phone, a smart phone, a wearable smart device (such as, for example, a ring, a watch, a pair of glasses, a bracelet, an ankle bracket, a belt, a necklace, an earring, a headband, a helmet, a device embedded in the cloths or the like), a personal computer (PC), a tablet personal computer (tablet), a phablet, a personal digital assistant (PDA), a digital camera, a portable game console, an MP3 player, a portable/personal multimedia player (PMP), a handheld e-book, an ultra mobile personal computer (UMPC), a portable lab-top PC, a global positioning system (GPS) navigation, and devices such as a high definition television (HDTV), an optical disc player, a DVD player, a Blue-ray player, a setup box, or any other device capable of wireless communication or network communication consistent with that disclosed herein. In a non-exhaustive example, the wearable device may be self-mountable on the body of the user, such as, for example, the glasses or the bracelet. In another non-exhaustive example, the wearable device may be mounted on the body of the user through an attaching device, such as, for example, attaching a smart phone or a tablet to the arm of a user using an armband, or hanging the wearable device around the neck of a user using a lanyard.

While this disclosure includes specific examples, it will be apparent to one of ordinary skill in the art that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. An ultra-wideband (UWB) antenna for wireless communication in proximity to a human body and between devices having no line-of-sight, the UWB antenna comprising:

symmetrical radiators having substantially identical sizes and shapes and disposed on a top surface of a dielectric layer;

a top dielectric layer disposed over the top surface of the dielectric layer;

a bottom dielectric layer disposed below a bottom surface of the dielectric layer;

a differential microstrip feeding line disposed on the top surface and the bottom surface of the dielectric layer;

a top connecting plate disposed on an outer surface of the top dielectric layer;

a bottom connecting plate disposed on an outer surface of the bottom dielectric layer; and a first inter-layer connector configured to connect an end of one of the symmetrical radiators to the top connecting plate; and a second inter-layer connector configured to connect an end of another of the symmetrical radiators to the bottom connecting plate, wherein the symmetrical radiators are aligned to be symmetrical with each other and comprise inner holes at substantially identical locations, each of the symmetrical radiators has an U-shape, the ends of each of the symmetrical radiators are cut, and outer perimeters of the symmetrical radiators comprise outer holes, wherein each of inner holes is formed by overlapping circles and each of the outer holes is in a shape of a portion of a circle, wherein the differential microstrip feeding line is disposed through a geometric center of the UWB antenna, and wherein electromagnetic waves of the symmetrical radiators propagate around curved object surfaces of inner holes and outer holes.

2. The UWB antenna of claim 1, wherein the symmetrical radiators have inner perimeters and the outer perimeters, each of which has a geometric shape.

3. The UWB antenna of claim 1, wherein each of the inner holes and the outer holes has a geometric shape.

4. The UWB antenna of claim 1, wherein a part of the differential microstrip feeding line is disposed orthogonally to a plane in which the symmetrical radiators exist.

5. The UWB antenna of claim 1, wherein each of the top connecting plate and the bottom connecting plate has a geometric shape.

6. An ultra-wideband (UWB) antenna comprising: a middle dielectric layer;

a first sub-radiator and a second sub-radiator, having substantially identical sizes and shapes, and being aligned symmetrical with each other and disposed on a top surface of the middle dielectric layer;

a top connecting plate connected to an end of the first sub-radiator;

a bottom connecting plate connected to an end of the second sub-radiator;

a differential micro trip feeding line disposed on the top surface and a bottom surface of the middle dielectric layer;

a top dielectric layer disposed on the top surface of the middle dielectric layer;

a bottom dielectric layer disposed below the bottom surface of the middle dielectric layer;

a first sub-inter-layer connector configured to connect the top connecting plate and the first sub-radiator; and a second sub-inter-layer connector configured to connect the bottom connecting plate and the second sub-radiator, wherein the differential microstrip feeding line is disposed through a geometric center of the UWB antenna, wherein each of the first sub-radiator and the second sub-radiator comprises inner holes disposed on an inner perimeter and outer holes disposed on an outer perimeter so that each of the first sub-radiator and the second sub-radiator has an U-shape, wherein the each of inner holes is formed by overlapping circles and the each of the outer holes is in a shape of a portion of a circle, and wherein electromagnetic waves of at least one of the first sub-radiator and the second sub-radiator propagate around curved object surfaces of at least one of the inner hole and the outer hole.

7. The UWB antenna of claim 6, wherein:

the first sub-inter-layer connector is disposed through the top dielectric layer to connect the top connecting plate and the first sub-radiator; and the second sub-inter-layer connector is disposed through the bottom dielectric layer to connect the bottom connecting plate and the second sub-radiator.

8. The UWB antenna of claim 6, wherein the differential microstrip feeding line is disposed orthogonally to a plane in which the symmetrical radiators exist.

9. The UWB antenna of claim 6, wherein the differential microstrip feeding line is disposed through a geometric center of the UWB antenna.

10. The UWB antenna of claim 6, wherein a width of the differential microstrip feeding line is configured to match an input of the UWB antenna to a 50 ohm resistance.

11. The UWB antenna of claim 6, wherein the first sub-radiator and the second sub-radiator are disposed between the top dielectric layer and the middle dielectric layer.

12. An ultra-wideband (UWB) antenna comprising:

a first dielectric layer;

radiators having substantially identical sizes and shapes and disposed on a top surface of the first dielectric layer;

a second dielectric layer disposed on the radiators and the top surface of the first dielectric layer;

a third dielectric layer disposed on a bottom surface of the first dielectric layer;

a differential microstrip feeding line disposed through a geometric center of the UWB antenna;

a first plate disposed on a surface of the second dielectric layer; a second plate disposed on a surface of the third dielectric layer; and a connector configured to connect the radiators to the first plate and the second plate, respectively, wherein the radiators are aligned to be symmetrical with each other and comprise inner holes, each of the radiators has an U-shape, the ends of each of the radiators are cut, and outer perimeters of the radiators comprise outer holes, wherein the each of inner holes is formed by overlapping circles and the each of the outer holes is in a shape of a portion of a circle, and wherein electromagnetic waves of the radiators propagate around curved object surfaces of at least one of inner holes and outer holes.

13. The UWB antenna of claim 12, further comprising:

a feeding line disposed in a portion between the first dielectric layer and the second dielectric layer and another portion between the first dielectric layer and the third dielectric layer.

14. The UWB antenna of claim 13, wherein:

the connector is disposed along an Y-axis through each of the second dielectric layer and the third dielectric layer; and the feeding line is disposed along an X-axis through a geometric center of the UWB antenna.

* * * * *